US007302907B2

(12) United States Patent
Carlton

(10) Patent No.: US 7,302,907 B2
(45) Date of Patent: Dec. 4, 2007

(54) MOUNTING SYSTEM AND METHOD FOR RIGIDLY ATTACHING A WATER SPORTS TOWING FRAME TO A VESSEL

(75) Inventor: Stephen Carlton, St. Cloud, FL (US)

(73) Assignee: Correct Craft, Inc., Orlando, FL (US)

( * ) Notice: Subject to any disclaimer, the term of this patent is extended or adjusted under 35 U.S.C. 154(b) by 0 days.

(21) Appl. No.: 11/459,440

(22) Filed: Jul. 24, 2006

(65) Prior Publication Data

US 2007/0034134 A1 Feb. 15, 2007

Related U.S. Application Data

(60) Provisional application No. 60/702,122, filed on Jul. 25, 2005.

(51) Int. Cl.
*B63B 17/00* (2006.01)

(52) U.S. Cl. ..... 114/364; 114/253

(58) Field of Classification Search ..... 114/253, 114/364

See application file for complete search history.

(56) References Cited

U.S. PATENT DOCUMENTS

| | | | | |
|---|---|---|---|---|
| 3,081,114 | A | 3/1963 | Esty | |
| 3,193,228 | A | 7/1965 | Chion | |
| 3,204,898 | A | 9/1965 | Manning | |
| 3,212,740 | A | 10/1965 | Greenberg | |
| 3,568,963 | A | 3/1971 | Koskinen | |
| 3,783,547 | A | 1/1974 | Bystrom et al. | |
| 4,304,385 | A * | 12/1981 | Farouche et al. | 248/410 |
| 4,597,354 | A | 7/1986 | Gelula | |
| 5,507,117 | A * | 4/1996 | Kalman et al. | 248/516 |
| 6,213,674 | B1 | 4/2001 | Sasaki et al. | |
| 6,554,170 | B1 | 4/2003 | Correll et al. | |
| 6,666,159 | B2 | 12/2003 | Larson et al. | |
| 6,802,275 | B2 | 10/2004 | Schmidt | |
| 6,865,999 | B2 | 3/2005 | Bierbower, Jr. | |
| 2004/0234330 | A1 | 11/2004 | Slatter | |
| 2004/0258460 | A1 | 12/2004 | Taylor | |
| 2005/0186029 | A1 | 8/2005 | Jones | |
| 2006/0088372 | A1 | 4/2006 | Erskine | |

FOREIGN PATENT DOCUMENTS

| | | |
|---|---|---|
| DE | 3730678 | 3/1989 |

* cited by examiner

*Primary Examiner*—Lars A. Olson
(74) *Attorney, Agent, or Firm*—Allen, Dyer, Doppelt, Milbrath & Gilchrist, P.A.

(57) ABSTRACT

A mounting system rigidly attaches a towing frame to a vessel deck, and includes a base having an arcuate top surface and a bottom surface conforming the deck. A joint member rigidly attached to the towing frame has an arcuate surface mating with the arcuate top surface of the base. The joint member has a cavity and a threaded bore extending through a wall for accessing the cavity. The threaded bore of the joint member is aligned with a bore extending through the base. A threaded shaft extends through a hole in the deck, through the bore in the base, and is threaded into the threaded bore of the joint member. A fastener attached to the shaft is used to bias the joint member against the base, and base against the deck for rigidly securing the joint member and thus the towing frame to the deck.

30 Claims, 7 Drawing Sheets

MOUNTING SYSTEM AND METHOD FOR RIGIDLY ATTACHING A WATER SPORTS TOWING FRAME TO A VESSEL

CROSS-REFERENCE TO RELATED APPLICATIONS

This application claims the benefit of U.S. Provisional Application No. 60/702,122, filed Jul. 25, 2005, for "Water Sports Towing Apparatus Mounting Device and Method," the disclosure of which is hereby incorporated by reference herein in its entirety, and commonly owned.

FIELD OF THE INVENTION

The present invention relates to mounting brackets and in particular to a mounting system and method for a water sports towing apparatus.

BACKGROUND OF THE INVENTION

As described by way of example with reference to U.S. Pat. No. 6,666,159 for a "Water Sport Towing Apparatus," it is well known to mount skeletal frames to boat decks. Typically, extremities of leg portions of a skeletal structure are mounted to deck portions of a boat using a mounting plate placed on a top surface of the deck, a backing plate positioned on an opposing bottom surface, and a fastening together using a nut and bolt arrangement. Legs of the skeletal structure may be pivotally mounted to the mounting plate for rotation about a pivot pin. As further illustrated with reference to U.S. Pat. No. 6,666,159, a top portion of the skeletal frame may be rotatable about a bottom portion. With such an arrangement, the bottom portion is typically mounted to the deck as above described. Alternatively, the mounting plate may be rigidly attached to the legs.

As is well known in the art, accurately and efficiently mounting the frame to the boat deck is often complicated by an out of plane deck top surface, imprecise mounting plate dimensions and features, generally unexpected appendages, and the like.

Typically, mounting a towing structure such as a frame includes the use of a mounting plate that is bolted to the deck wherein the bolts pass through the mounting plate through the deck and through a backing plate that is then secured by tightening against a nut threaded to the bolt. A leg may be pivotally connected to the mounting plate. One of skill in the art knows that such legs may be integrally formed and fixed to the mounting plate base prior to attachment to the deck of the boat. However, whether pivotally mounting or fixed, the unevenness of most decks presents installation inefficiencies and inaccuracies that may include misaligning the frame. By way of example, if the mounting plate has four bolts aligning the bolts within four holes passing through the deck while accounting for unevenness of the deck may cause the installer to have to re-drill holes which for those skilled in the art will appreciate is not a desirable method of installation.

The present invention is generally directed to mounting of structures. By way of example and as herein presented, embodiments of the present invention are presented for improving the efficiency and accuracy desired when assembling such a structure and attaching it to a vessel.

SUMMARY

The present invention may be described, by way of example, for a mounting system for rigidly attaching a water sports towing frame to a vessel. The mounting system may comprise a towing frame having a leg extending therefrom, a support structure having opposing top and bottom surfaces, the support structure having an aperture extending therethrough, a base having opposing top and bottom surfaces and a bore extending therethrough, wherein the top surface includes an arcuate surface portion and the bottom surface conforms to the top surface of the support structure and is carried thereby, and wherein the aperture and bore are generally aligned. Further, a joint member is rigidly attached to the leg of the towing frame, the joint member having an arcuate surface portion mating with the arcuate surface portion of the base in a frictional contact therewith, the joint member having a cavity therein and a threaded bore extending through a wall portion thereof for accessing the cavity, the bore of the joint member generally aligned with the bore of the base. A shaft having a threaded portion extends through the aperture of the support structure, extending through the bore in the base, and in a threaded engagement with the threaded bore of the joint member, and a fastener operable with the shaft for biasing the joint member against the base, and base against the support structure for rigidly securing the joint member and thus the leg of the frame to the support structure.

A mounting bracket may comprising the base having opposing top and bottom surfaces and a bore extending therethrough, wherein the top surface includes an arcuate surface portion and the bottom surface is dimensioned to generally conform to a surface of a support structure to be carried thereby, a joint member having an arcuate surface portion mating with the arcuate surface portion of the base in a frictional contact therewith, the joint member having a cavity therein and a bore extending through a wall portion thereof for accessing the cavity, the bores of the joint member and the base being generally aligned, a shaft extending through the bore in the base and into the bore of the joint member, and fastening means operable with the shaft for biasing the joint member against the base.

A method aspect of the invention may comprise providing a towing frame having a forward leg and an aft leg extending therefrom, providing forward and aft joint members, each joint member having an arcuate surface portion, rigidly attaching the forward and aft joint members, respectively, to end portions of the forward and aft legs, preselecting a forward portion and an aft portion of the deck to which the forward and aft legs are to be attached, providing an aperture through each of the forward and aft portions of the deck extending from a top surface to a bottom surface thereof, providing a forward base and an aft base, each having opposing top and bottom surfaces and a bore extending therethrough, wherein the top surface includes an arcuate surface portion, and wherein the bottom surface conforms, respectively, to the forward and aft top surfaces of the deck, placing the forward and aft bases at the forward and aft deck portions while aligning the apertures and bores, respectively, extending a forward and an aft shaft through corresponding bores within the forward and aft bases into the joint members respectively, mating the arcuate surface portion of the joint member with the arcuate surface portion of the base, each shaft sufficiently dimensioned for extending through the deck to beyond the deck bottom surface, providing a fastener for each of the forward and aft shafts, each fastener carried below the deck bottom surface, loosely securing the joint member against the base, and base against the deck, positioning the frame as desired through a moving of each base along the deck top surface, and then further securing the shaft for rigidly securing each joint member to each base, the base to the deck, and thus the frame to the vessel.

Embodiments of the present invention are herein presented by way of example for a mounting device. Embodiments as herein described, by way of example, are useful in mounting a water sports towing structure to a deck of a boat. An embodiment for mounting a towing frame to the deck of a boat may include a base having an aperture extending therethrough and a rotatable, spherical joint operable within a cooperating seat of the base. A threaded rod may be extended through the deck of the boat, through the aperture in the base, and into the spherical joint for securing the joint to the rod at a preselected angle. A leg of the towing frame may be pre-attached to the spherical joint. In an assembly of the spherical joint to the base and ultimately to the deck of the boat, the threaded rod is extended through an aperture in the deck and secured into the spherical joint. At an underside of the deck, the rod may extend through a backing plate. A fastener, such as a threaded nut may be secured to the rod for tightening against the bottom side of the deck or backing plate and thus secure the base to the deck. During the installation of the towing tower, the nut may be loosely attached to the rod for allowing the leg and spherical joint to be loosely fitted within the seat for arranging forward and aft mounting devices in the desired position. Once in a desired position, the nuts for forward and aft mounting devices are secured thus allowing the frame to be secured to the deck as desired.

BRIEF DESCRIPTION OF THE DRAWINGS AND PHOTOGRAPHS

Features and benefits of the present invention will become apparent as the description proceeds when taken in conjunction with the accompanying drawings and photos in which.

Figure 1:
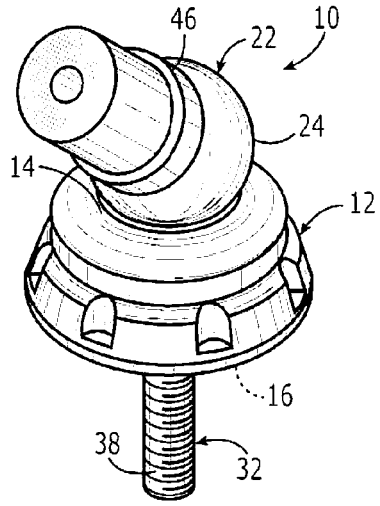
FIG. 1 is a partial perspective view of one embodiment of a mounting device in keeping with the teachings of the present invention.
Figure 1A:
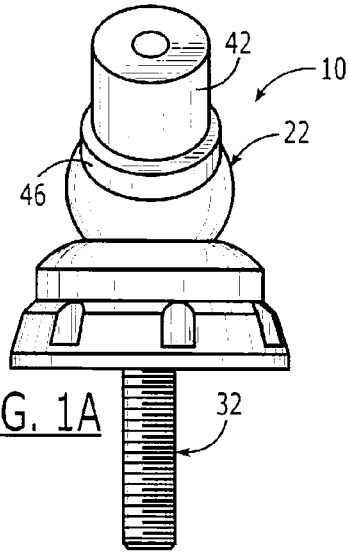
FIGS. 1A and 1B are front and side elevation views, respectively, of the embodiment of FIG. 1.
Figure 1B:
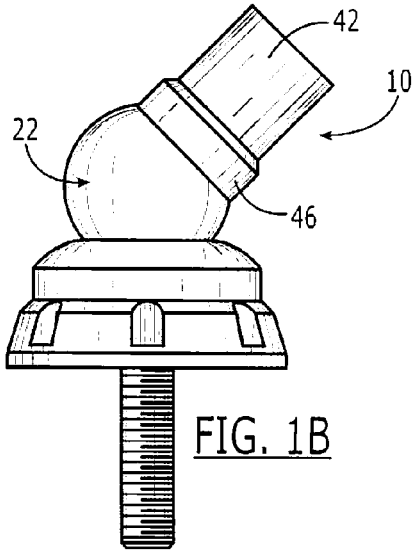
Figure 3:
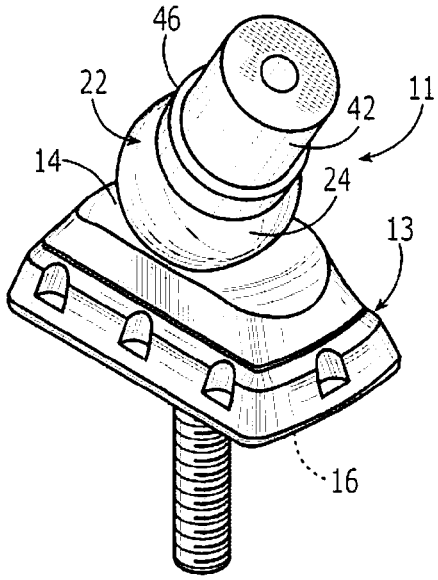
FIG. 3 is a partial perspective view of a second embodiment of the mounting device of FIG. 1.
Figure 3A:
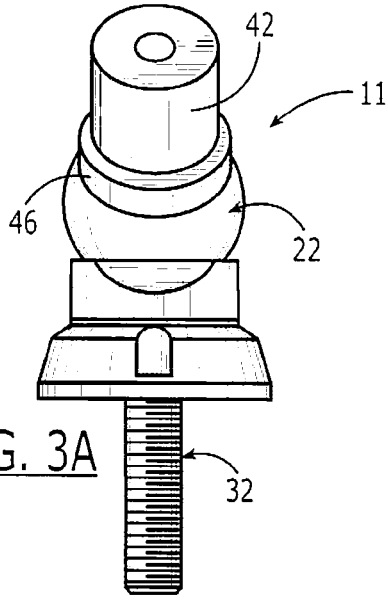
FIGS. 3A and 3B are front and side elevation views, respectively, of the embodiment of FIG. 2.
Figure 3B:
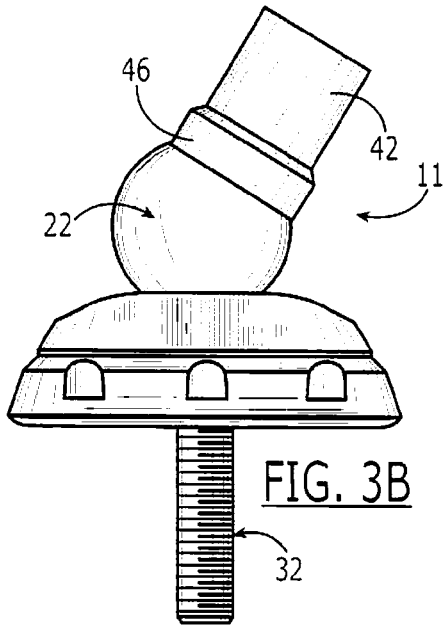
Figure 8:
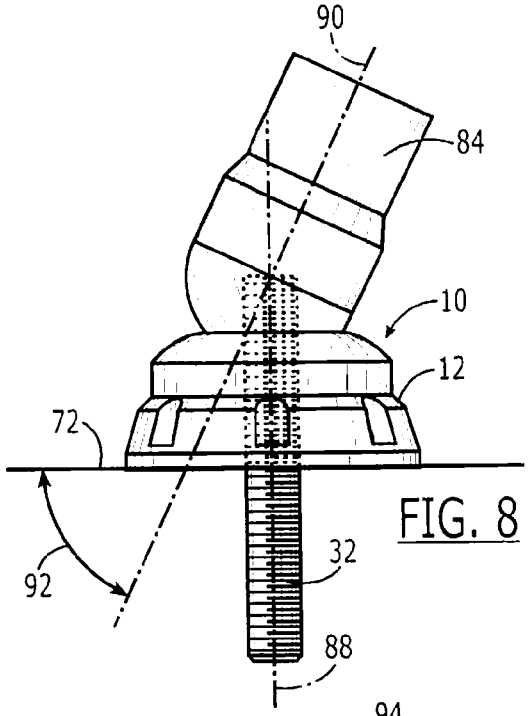
Figure 8A:
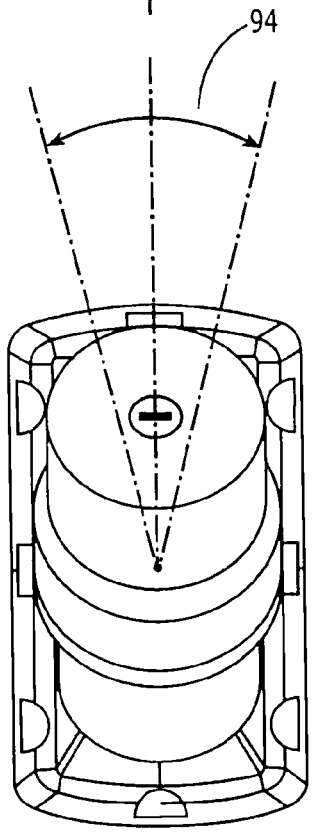

FIGS. 8 and 8A include partial cross sectional and top plan views, respectively, of the embodiment of FIGS. 1 and 3, respectively, illustrating an alignment of elements, by way of example.

DETAILED DESCRIPTION OF EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Referring initially to FIG. 1, one mounting bracket 10 in keeping with the teachings of the present invention comprises a base 12 herein defined as having a top surface 14 and an opposing bottom surface 16. As illustrated with reference to FIG. 2, a bore 18 extends through the base 12. The top surface 14 includes an arcuate surface portion 20, herein concave, by way of example. The bottom surface 16 is dimensioned to generally conform to a surface of a support structure such as a deck of a boat as will herein be described later in this disclosure. With continued reference to FIGS. 1 and 2, a joint member 22 includes an arcuate surface portion 24, herein convex, for mating with the arcuate surface portion 20 of the base 12 (herein concave by way of example) in a frictional contact therewith. For the embodiment herein described by way of example, the cooperating surfaces 20, 23 are generally spherical forming a ball joint styled connection. For an embodiment herein described by way of example, the joint member 22 includes a cavity 26 therein and a bore 28 extending through a wall portion 30 thereof for accessing the cavity. The bores 18, 28 of the joint member 22 and the base 12 are generally aligned. A shaft 32 loosely extends through the bore 18 in the base 12 and is secured into the bore 28 of the joint member 22. As illustrated, by way of example, with continued reference to FIG. 2, a fastener 34 in the form of a nut 36 is threaded onto a threaded portion 38 of the shaft 32. As will be further addressed later in this disclosure, such an arrangement allows the joint member 22 to be biased against the base 12, and base 12 again the deck 40, herein providing a support structure.

Figure 4:
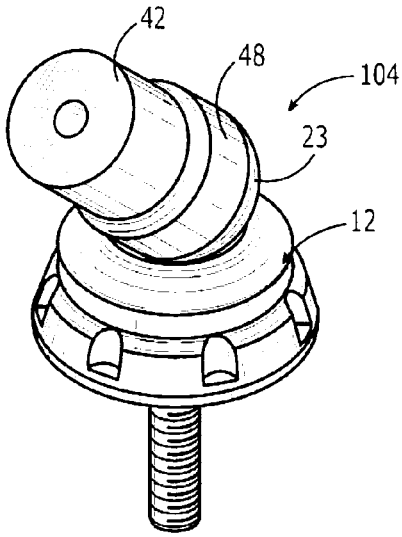
FIG. 4 is a partial perspective view of a third embodiment of the mounting device of FIG. 1.
Figure 4A:
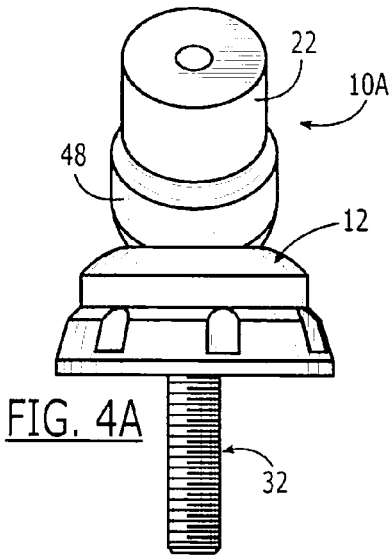
FIGS. 4A and 4B are front and side elevation views, respectively, of the embodiment of FIG. 4.
Figure 4B:
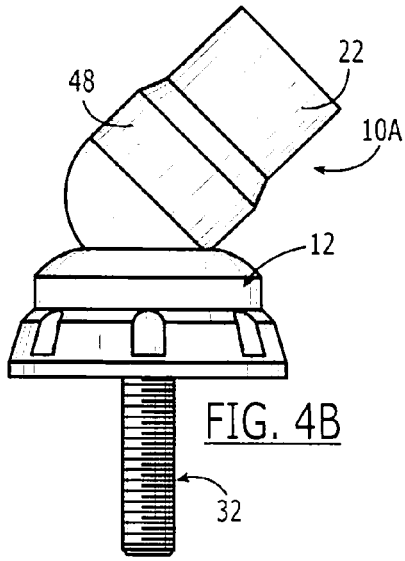
Figure 5:
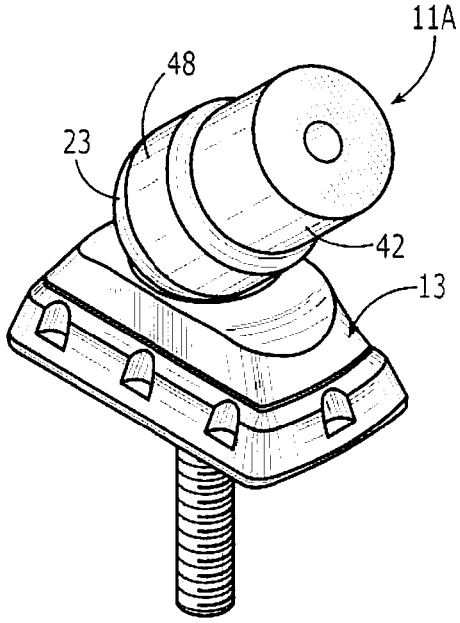
FIG. 5 is a partial perspective view of a fourth embodiment of the mounting device of FIG. 1.
Figure 5A:
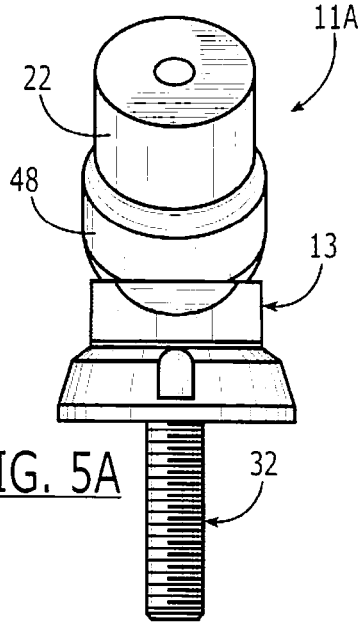
FIGS. 5A and 5B are front and side elevation views, respectively, of the embodiment of FIG. 5.
Figure 5B:
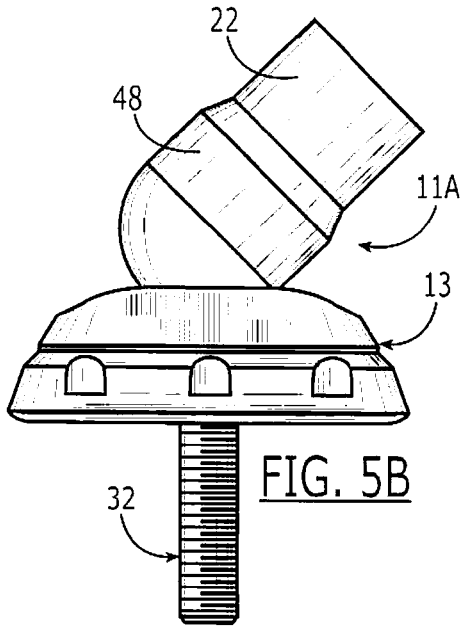

As illustrated with reference to FIG. 3 alternate embodiments of the mounting bracket 10 will come to the mind of one skilled in the art depending upon a desired appearance, shape, and location desired, such as a mounting bracket 11 having a generally rectangular shaped base 13 as compared to the generally circular shaped base of the bracket 10. An example will be later presented in greater detail in this disclosure. Yet further, and as illustrated with reference to FIGS. 4 and 5, the joint member 22 described with reference to FIGS. 1 and 2, may be modified to accommodate attachment to various structures. By way of example, and with reference again to FIG. 2, and to FIGS. 3-5, the joint member 22 may comprise a male fitting 42 extending from a body portion 23 of the joint member. The male fitting may be attached to a leg 44 through a welding connection, by way of example, as illustrated with reference again to FIG. 2. Depending on a desired connection to the leg 44, the male fitting 42 may have an extended portion 46 or a modified extended portion 46, as illustrated by way of example with reference to the brackets 10A, 11A of FIGS. 4 and 5.

By way of further illustration, front and side views respectively for the brackets 10, 11, 10A, and 11A are presented with reference to FIGS. 1A and 1B, 3A and 3B, 4A and 4B, and 5A and 5B.

Figure 6:
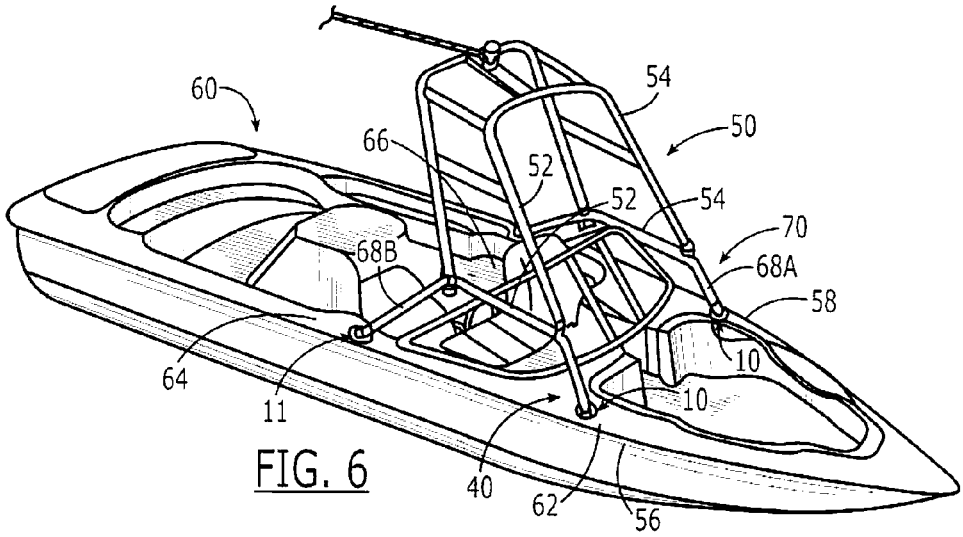
FIG. 6 is a partial perspective view of a vessel having a towing frame attached thereto.
Figure 7:
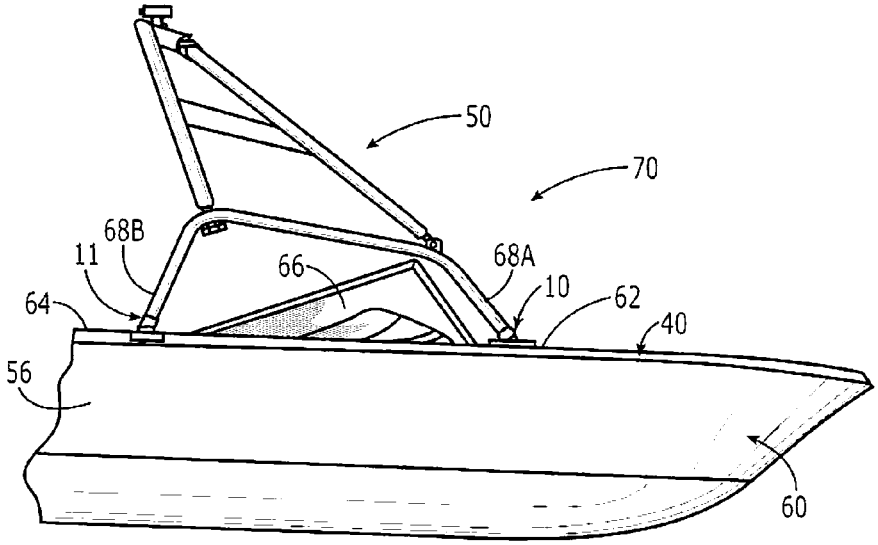
FIG. 7 is a partial side elevation view of the vessel of FIG. 5.

With reference now to FIGS. 6 and 7, and as described in U.S. Pat. No. 6,666,159, the disclosure of which is herein incorporated by reference, one towing frame 50 may comprise starboard and port vertical supports 52, 54 that are desirably rigidly attached to starboard and port sides 56, 58 of a vessel 60. For the disclosure herein presented by way of example, the vertical supports 52, 54 will be attached to forward and aft (gunwales) deck portions 62, 64 of the vessel 60 at locations generally outboard the operator station 66. Each of the vertical supports 52, 54 includes an upwardly extending forward leg 44A having a proximal end 68A that is to be rigidly mounted the deck 40 at a deck forward portion 62, and an upwardly extending aft leg 44B having a proximal end 68B that is to be rigidly mounted to an aft deck portion 64.

For the towing frame 50 above described with reference to FIGS. 6 and 7, and as herein described by way of example for an embodiment of the invention, a mounting system 70 for rigidly attaching the towing frame to the vessel 60 may be described as including the towing frame 50 having the leg, forward leg 44A, aft leg 44B extending therefrom, as above described with reference to FIGS. 6 and 7. Foe the example herein described, the deck 40 provides a support structure having opposing top and bottom surfaces 72, 74, as illustrated with reference again to FIG. 2. The deck 40 includes an aperture 76 extending therethrough. With continued reference to FIG. 2, and as above described, the mounting bracket 10 includes the base 12. The base 12 may generally have its bottom surface 16 conforming to the deck top surface 72 and is carried by the deck 40, or other appropriate supporting surface such as flooring, by way of example. As illustrated with reference again to FIGS. 6 and 7, the system 70 illustrated here, by way of example, includes the mounting bracket 10 (earlier described with reference to FIG. 1) at the forward deck portions 62, and the mounting bracket 11 (earlier described with reference to FIG. 3) at the aft deck portions 64. Such design choice will come to those of skill in the art now having the benefit of the teachings of the present invention.

Figure 2:
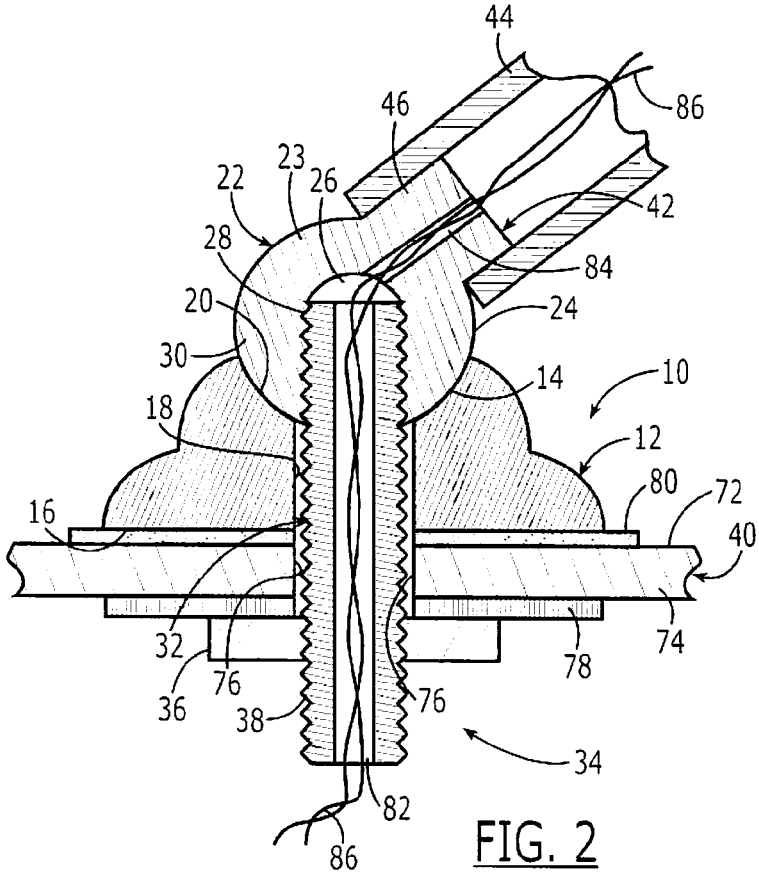
FIG. 2 is a partial cross-sectional view for one embodiment of the present invention.

With continued reference to FIG. 2, the aperture 76 and the bore 18 are aligned. The joint member 22 is welded to the leg 44 for providing a rigid attachment of the joint member to the leg and thus the supports 52, 54. As above described with reference to FIGS. 1, 3, 4, and 5, the tubular leg 44 may be attached to the male fitting 42. Alternatively, a threaded male fitting may be used with a threaded tubular leg. By way of example, the shaft 32 is tubular and threaded on its outside surface. The shaft 32 extends through the aperture 76 of the deck 40; extends through the bore 18 in the base 12; and is threaded into the threaded bore 28 of the joint member 22. A backing plate 78 is carried between the nut 36 the deck bottom surface 74. A gasket 80 is carried between the bottom surface 16 of the base 12 and the deck top surface 72. Tightening the nut 36 against the backing plate 78 biases the joint member 22 against the base 12, and biases the base against the deck 40 for rigidly securing the joint member and thus the leg 40 of the frame 50 to the deck 40. It will come to the mind of those skilled in the art that a bolt having a head may be used, or suitable alternatives to bias the joint member against the base and thus the deck.

With reference again to FIG. 2, one embodiment of the invention includes the shaft 32 in a tubular form having a bore 82 extending through the shaft. With a tubular leg 40, the tubular shaft 32 extending into the cavity 26 of the joint member 22, and a bore 84 extending through the male fitting, an electrical cable 86 may be extended from below deck to the frame. Such cable 86 may be desired for lighting, audio signal transmission, and the like.

By way of example with regard to a method of installing the frame 50, and with reference again to FIGS. 1, 2, and 7, and to FIG. 8, an axis 88 of the bore 28 of the joint member 22 may be pre-selected based on a leg axis 90 for the structure of the frame 50 or its supports 52, 54, for the example illustrated herein. The bases 12, 13 and gaskets 80 are put in the appropriate forward and aft deck portions 62, 64. For one method as herein described by way of example, the shaft 32 is threaded into the joint member 22, and the shaft is inserted through the bore 18 of the base 12 and through the aperture 76 in the deck for both the forward and aft positions. The backing plate 78 is placed onto the shaft 32 below the deck bottom surface 74 and the nut 36 is threaded onto the shaft to loosely position the backing plate 78 against the deck bottom surface 74. Once the legs 40, 68A, 68B are aligned as desired, the nut 36 is tightened for pulling the joint members 22 against the base 12 and thus against the gasket 80 for frictionally securing the mounting brackets 10, 11 and thus the towing frame 50 to the deck 40.

As illustrated by way of example with reference again to FIG.8, and to FIG. 8A, while the threaded shaft 32 is loosely connected, the joint member 22 and the base 12 may be adjusted about an appropriate angle 92, 94 during assembly. Such adjustment may accommodate unevenness in the deck 40 or in the placement of the bases 12, 13 on the deck. Further, the use of a single axis 88 connection such as that for the shaft 32, as opposed to multiple connections such as typically done for nuts and bolts described above, allows for ease and efficiency in installation.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A mounting system for rigidly attaching a water sports towing frame to a vessel, the mounting system comprising:

a towing frame having a leg extending therefrom;

a support structure having opposing top and bottom surfaces, the support structure having an aperture extending therethrough;

a base having opposing top and bottom surfaces and a bore extending therethrough, wherein the top surface includes an arcuate surface portion and the bottom surface conforms to the top surface of the support structure and is carried thereby, and wherein the aperture and bore are generally aligned;

a joint member rigidly attached to the leg of the towing frame, the joint member having an arcuate surface portion mating with the arcuate surface portion of the base in a frictional contact therewith, the joint member having a cavity therein and a threaded bore extending through a wall portion thereof for accessing the cavity, the bore of the joint member generally aligned with the bore of the base;

a shaft having a threaded portion thereon, the shaft extending through the aperture of the support structure, extending through the bore in the base, and in a threaded engagement with the threaded bore of the joint member; and a fastener operable with the shaft for biasing the joint member against the base, and base against the support structure for rigidly securing the joint member and thus the leg of the frame to the support structure.

2. A mounting system according to claim 1, wherein the support structure comprises a deck of the vessel.

3. A mounting system according to claim 1, wherein the bottom surface of the base is at least one of substantially flat and contoured.

4. A mounting system according to claim 1, wherein the arcuate portion of the base forms a concave surface.

5. A mounting system according to claim 1, wherein the joint member comprises a male fitting portion extending therefrom, and wherein the male fitting is attached to the leg.

6. A mounting system according to claim 1, wherein the fastener comprises a nut in threaded engagement with the shaft.

7. A mounting system according to claim 1, wherein the fastener comprises a head of the shaft.

8. A mounting system according to claim 1, further comprising a backing plate carried between the fastening means and the bottom surface of the support structure, the fastening means biased against the backing plate.

9. A mounting system according to claim 1,further comprising a gasket carried between the bottom surface of the base and the top surface of the support structure.

10. A mounting system according to claim 1, wherein the shaft includes a bore extending therethrough, and wherein the leg comprises a tube having a bore therein.

11. A mounting system according to claim 1, wherein the shaft includes a bore extending therethrough, and wherein an electrical cable extends from proximate the bottom surface of the support structure through the bore in the shaft and into a bore of the leg.

12. A mounting bracket comprising:

a base having opposing top and bottom surfaces and a bore extending therethrough, wherein the top surface includes an arcuate surface portion and the bottom surface is dimensioned to generally conform to a surface of a support structure to be carried thereby;

a joint member having an arcuate surface portion mating with the arcuate surface portion of the base in a frictional contact therewith, the joint member having a cavity therein and a bore extending through a wall portion thereof for accessing the cavity, the bores of the joint member and the base being generally aligned;

a tubular shaft extending through the bore in the base and into the bore of the joint member; and fastening means operable with the shaft for biasing the joint member against the base.

13. A mounting bracket according to claim 12, wherein the bottom surface of the base is at least one of substantially flat and contoured.

14. A mounting bracket according to claim 12, wherein the arcuate portion of the base forms a concave surface.

15. A mounting bracket according to claim 12, wherein the joint member comprises a male fitting portion extending therefrom, and wherein the male fitting is dimensioned for attaching to a leg.

16. A mounting bracket according to claim 12, wherein the fastening means comprises a nut in threaded engagement with the shaft.

17. A mounting bracket according to claim 12, wherein the fastening means comprises a proximal end of the shaft threadingly engaged with the bore of the joint member, and a distal end of the shaft engaging a nut for biasing the joint member against the base.

18. A mounting bracket according to claim 12, further comprising a cable extending through the tubular shaft into and through the cavity.

19. A method for rigidly attaching a towing frame to a vessel, the method comprising:

providing a towing frame having a forward leg and an aft leg extending therefrom;

providing forward and aft joint members, each joint member having an arcuate surface portion;

rigidly attaching the forward and aft joint members, respectively, to end portions of the forward and aft legs;

extending a shaft from each of the forward and aft joint members;

preselecting a forward portion and an aft portion of the deck to which the forward and aft legs are to be attached;

providing an aperture through each of the forward and aft portions of the deck extending from a top surface to a bottom surface thereof;

providing a forward base and an aft base, each having opposing top and bottom surfaces and a bore extending therethrough, wherein the top surface includes an arcuate surface portion, and wherein the bottom surface conforms, respectively, to the forward and aft top surfaces of the deck;

placing the forward and aft bases at the forward and aft deck portions while aligning the apertures and bores, respectively;

extending the forward and aft shaft through corresponding bores within the forward and aft bases;

mating the arcuate surface portion of the joint member with the arcuate surface portion of the base, each shaft sufficiently dimensioned for extending through the deck to beyond the deck bottom surface;

providing a fastener for each of the forward and aft shafts, each fastener carried below the deck bottom surface;

loosely securing the joint member against the base, and base against the deck;

positioning the frame as desired through a moving of each base along the deck top surface; and further securing the shaft for rigidly securing each joint member to each base, the base to the deck, and thus the frame to the vessel.

20. A method according to claim 19, wherein at least one leg comprises a tubular leg, each joint member further includes a cavity, and at least one shaft comprises a tubular shaft for providing access through the tubular shaft through the cavity, and into the tubular leg, the method further comprising extending an electrical cable from below the deck into the tubular leg.

21. A method according to claim 19, wherein the joint member includes a threaded bore extending through a wall portion thereof for accessing a cavity therein.

22. A method according to claim 21, wherein each shaft includes a threaded portion thereon, and wherein the shaft extending comprises providing a threading engagement of the shaft to the joint member.

23. A method according to claim 19, wherein the joint member comprises a male fitting portion extending therefrom, and wherein the rigidly attaching the forward and aft joint members, respectively, to end portions of the forward and aft legs comprises rigidly attaching the male fitting to a female portion of each leg.

24. A method according to claim 19, wherein the fastener comprises a nut in threaded engagement with the shaft, and wherein the fastener providing comprises threadingly engaging the nut to the threaded shaft below the deck lower surface.

25. A method according to claim 19, further comprising placing a backing plate between the fastener and the bottom surface of the deck, wherein the securing comprises biasing the fastener against the backing plate.

26. A method according to claim 19, further comprising placing a gasket between the bottom surface of the base and the top surface of the deck.

27. A method for rigidly attaching a towing frame to a vessel, the method comprising:

providing a towing frame having a forward leg and an aft leg extending therefrom;

providing forward and aft joint members, each joint member having an arcuate surface portion;

rigidly attaching the forward and aft joint members, respectively, to end portions of the forward and aft legs;

preselecting a forward portion and an aft portion of the deck to which the forward and aft legs are to be attached;

providing an aperture through each of the forward and aft portions of the deck extending from a top surface to a bottom surface thereof;

providing a forward base and an aft base, each having opposing top and bottom surfaces and a bore extending therethrough, wherein the top surface includes an arcuate surface portion, and wherein the bottom surface conforms, respectively, to the forward and aft top surfaces of the deck;

placing the forward and aft bases at the forward and aft deck portions while aligning the apertures and bores, respectively;

extending a forward and an aft shaft through corresponding bores within the forward and aft bases into the joint members respectively;

mating the arcuate surface portion of the joint member with the arcuate surface portion of the base, each shaft sufficiently dimensioned for extending through the deck to beyond the deck bottom surface;

providing a fastener for each of the forward and aft shafts, each fastener carried below the deck bottom surface;

loosely securing the joint member against the base, and base against the deck;

positioning the frame as desired through a moving of each base along the deck top surface; and further securing the shaft for rigidly securing each joint member to each base, the base to the deck, and thus the frame to the vessel.

28. A method according to claim 27, wherein at least one leg comprises a tubular leg, each joint member further includes a cavity, and at least one shaft comprises a tubular shaft for providing access through the tubular shaft through the cavity, and into the tubular leg, the method further comprising extending an electrical cable from below the deck into the tubular leg.

29. A method according to claim 27, wherein the joint member includes a threaded bore extending therein, and wherein the shaft extending through corresponding bores within the forward and aft bases into the joint members, respectively, comprises threadingly engaging each shaft to each respective joint member.

30. A method according to claim 27, wherein the fastener comprises at least one of a nut in threaded engagement with the shaft and a head engaged with the shaft, and wherein the securing comprises at least one of screwing the nut onto the threaded shaft and screwing the shaft into the threaded bore of the joint member.

* * * * *